US005706530A

United States Patent [19]

Mariano

[11] Patent Number: 5,706,530

[45] Date of Patent: Jan. 13, 1998

[54] SKIMMER SEAL FOR SWIMMING POOL

[76] Inventor: Albert S. Mariano, 16 Kazimer Dr., Billerica, Mass. 01862

[21] Appl. No.: 524,750

[22] Filed: Sep. 7, 1995

[51] Int. Cl.[6] ..... E04H 4/14

[52] U.S. Cl. ..... 4/496; 138/32

[58] Field of Search ..... 4/496, 504, 507; 138/32, 114

[56] References Cited

U.S. PATENT DOCUMENTS

| | | | |
|---|---|---|---|
| 3,353,565 | 11/1967 | Markham | 138/89 |
| 3,443,264 | 5/1969 | Miller | 4/172 |
| 3,552,567 | 1/1971 | Arp | 210/169 |
| 4,092,746 | 6/1978 | Harris | 4/507 X |
| 4,281,422 | 8/1981 | Simonelli | 4/496 |
| 4,610,783 | 9/1986 | Hudson | 210/169 |
| 4,725,352 | 2/1988 | Haliotis | 210/169 |
| 4,752,979 | 6/1988 | Goacher | 4/496 |
| 4,921,617 | 5/1990 | Antoine et al. | 210/776 |
| 5,060,321 | 10/1991 | Breneisen | 4/496 |
| 5,225,075 | 7/1993 | Cunningham | 210/169 |
| 5,238,585 | 8/1993 | Reed, Sr. | 210/805 |

*Primary Examiner*—Charles E. Phillips
*Attorney, Agent, or Firm*—Pearson & Pearson

[57] ABSTRACT

An improved seal for insertion into a skimmer of a swimming pool that attaches to an intake pipe of the pool filtration equipment and extends into the walled region of the skimmer to provide a compressible body absorbing the expansion of ice during freeze-up of the pool. The seal comprises an air valve for introducing air via an inner shaft into the intake pipe line to clear out water. The seal obviates having to lower the pool water level.

14 Claims, 3 Drawing Sheets

SKIMMER SEAL FOR SWIMMING POOL

BACKGROUND OF THE INVENTION

The present invention relates to swimming pools and in particular to a device for protecting a pool skimmer and water lines from freezing during cold weather.

Swimming pools located in climates where water freezes are winterized in order to avoid damage to pipes and other parts of a pool system such as in the region of a pool skimmer. One method of winterization has been to insert a funnel into an intake pipe opening and insert an air compressor hose into the funnel opening in order to force air into the pool lines to clear the lines of water. However, a problem with this method is that the funnel does not completely seal the opening to the intake pipe. Also, to perform this method the pool has to be drained below the skimmer to remove all water from the skimmer area so that the water does not enter the intake pipe after the lines have been cleared of water. However, it is desirable to maintain a significant amount of water in the pool to prevent inward collapsing of the pool due to frost in the ground pushing against the pool walls.

In U.S. Pat. No. 3,552,567, a cylindrical shaped device is described that is positioned inside a pool skimmer with one end being screwed into an intake pipe for drawing water from the pool to a pump and filter. The device has a blow-molded body formed of resilient resin material and it has a diameter larger than the intake pipe. At the top of the body of the device is a crossbar projection extending upward to provide a finger grip for screwing the device into the intake pipe. With the device in place, the intake pipe is protected from ice or debris and the device extends above the intake pipe into a walled region of the skimmer where it can be compressed by expanding ice to protect walls from ice pressure. The resilient material forming the device body and the air it contains are readily compressed by expanding ice. However, this device does not provide for clearing water from the intake pipe to the filter system.

In U.S. Pat. No. 5,225,075, a skimmer winterizing plug for a swimming pool is described that is screwed into a threaded port of a skimmer. The plug includes an air valve through which air can be introduced and the air is discharged into a downwardly extending flexible tube or hose. An air pump attached to the air valve provides air into the line which causes the water level in the line to be lowered to a desired level below a winterizing level for the pool; thus making the pipe less vulnerable to damage by water freezing. However, this plug is useful only when the water level of the pool is lowered significantly resulting in no water being in the skimmer, and the air does not clear the pipe of water to which it is introduced.

The present invention is an improvement over the prior art for providing winter protection for the pool skimmer and water line extending from the skimmer.

SUMMARY

It is an object of this invention to provide an improved winterizing apparatus for a skimmer of a swimming pool without requiring the pool water to be lowered below the skimmer.

It is another object of the invention to prevent a pool skimmer from breaking in freezing weather conditions by absorbing pressure from ice build-up in the skimmer.

It is a further object of the invention to provide for clearing the water out of the intake water line connecting to filtration equipment in order to maintain air pressure in the water lines while water remains in the skimmer.

The objects are further accomplished in a swimming pool having a skimmer including a walled region and an intake water line for connection to filtration equipment, by a seal for protecting the skimmer and the water line from ice damage comprising a partially hollow substantially closed body having an outer wall of resilient material, the body extending from the intake water line to be compressibly disposed within the skimmer walled regions, a first end of the body having valve means for introducing and maintaining air under pressure to the intake pipe, a second end of the body having a cylindrical projection, the projection having external screw threads for threading into the intake water line, and means within the body extending from the first end to the second end for directing the air through the body. The valve means comprises a self-sealing air valve. The first end further comprises a crossbar means extending upward, having the valve means positioned in the center of the crossbar, for providing a finger grip to screw the seal into the intake water line. The self-sealing air valve seals a pocket of air in the water lines to prevent water from reentering the water lines from the skimmer. The outer wall of the body comprises blow-molded plastic for allowing the seal to expand and contract as ice accumulates in the skimmer. The air directing means comprises a cylindrical shaft having a strong wall for preventing expansion and contraction of the shaft walls thereby preventing the forced air from fracturing the shaft.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
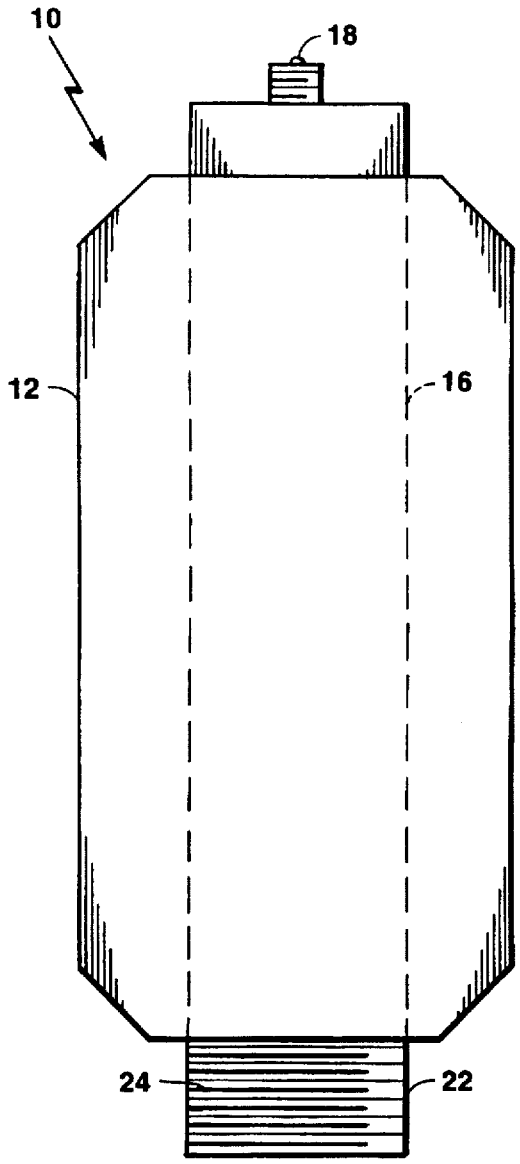
FIG. 1 is a side elevational view of a skimmer seal according to the invention.

Referring to FIG. 1 a seal 10 is shown having a blow-molded body 12 that forms the outside of the invention which is substantially closed and formed of resilient resin material. The body 12 of the seal 10 is generally cylindrical as shown and has a hollow inner cylindrical shaft 16 running from top to bottom of the body 12. The wall of the inner shaft 16 is made from a strong plastic material in order to prevent expansion and contraction of the inner shaft wall 16.

Figure 2:
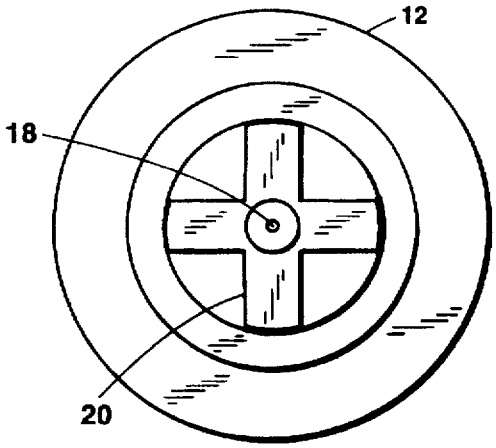
FIG. 2 is a plan view of the skimmer seal.
Figure 3:
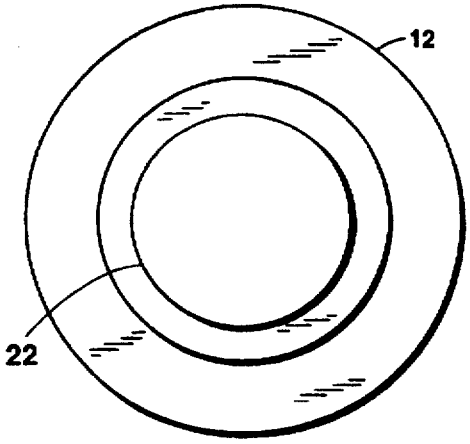
FIG. 3 is a bottom view of a cylindrical projection of the skimmer seal.

Referring to FIG. 2 and FIG. 3, a plan view of the body 12 is shown in FIG. 2 comprising a self-sealing air valve 18 which is positioned in the center of an X-shaped crossbar projection 20 that extends upwards to permit a finger grip for screwing the body 12 into an intake water line or pipe (not shown). At the bottom of the body 12 a cylindrical projection 22 extends downward from the body 12 and has external threads 24 for threading into the internal threads of the intake water line or pipe connected to pool filtration equipment. Projection 22 and threads 24 can be made in different sizes to fit different intake water lines as desired. When the water line is not provided with threads an adapter (not shown) can be used having threads on one end and the other end having a slightly smaller diameter for inserting into the water line thereby providing a tight friction fit. FIG. 3 is a bottom view of the cylindrical projection 22 showing the circular opening for air flow to the water line.

The operation of the seal provides for winterization of swimming pools without having to lower the water level. When the seal 10 is screwed into the intake water line which leads to filtration equipment, an air pump is connected to the air valve 18 and air is forced through the air valve 18 under pressure into the intake water line. As the air pressure increases in the water line, water is forced out and when the air pump is removed, air remains in the shaft 16 of the seal 10 and in the water line, thereby preventing any freeze-up problems. The water is allowed to remain in the pool and the skimmer and the resilient material of the outer wall 12 of the seal 10 can be compressed by expanding ice, thereby protecting the walls of the skimmer from ice pressure.

Figure 4:
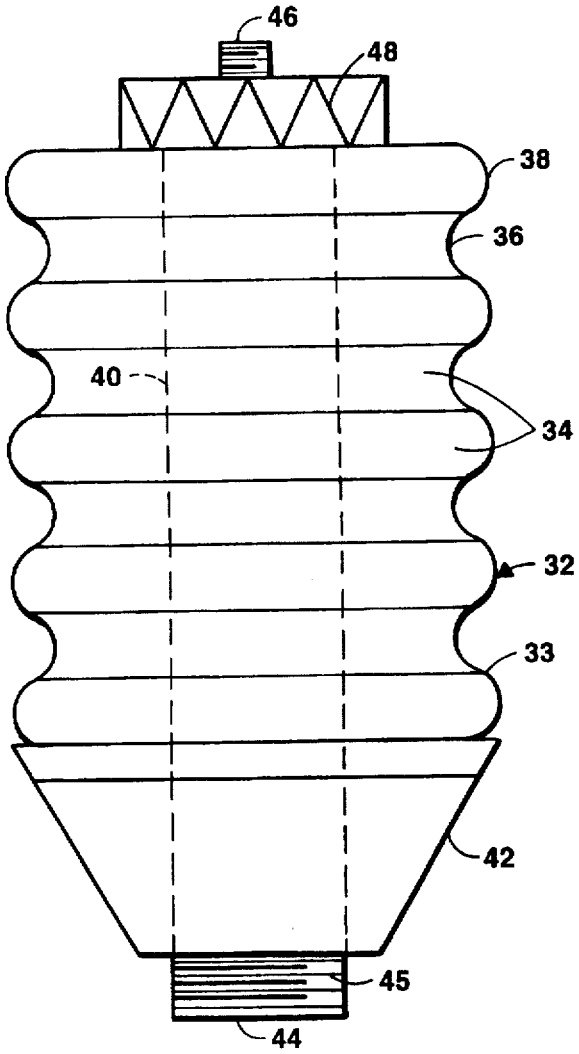
FIG. 4 is a side elevational view of a second embodiment of a skimmer seal having a plurality of vertically stacked sections with alternating concave and convex edges forming a side wall.
Figure 5:
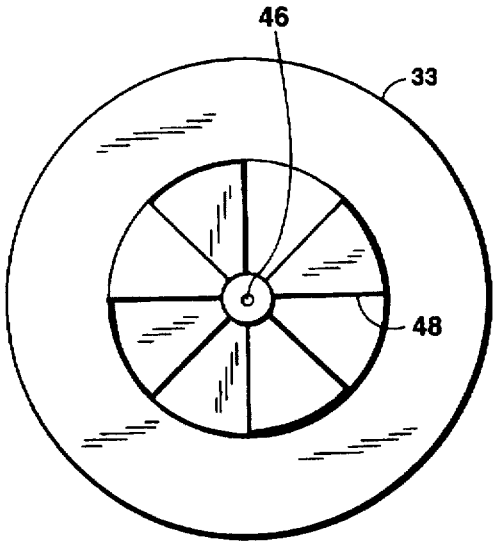
FIG. 5 is a plan view of the second embodiment of the skimmer seal.
Figure 6:
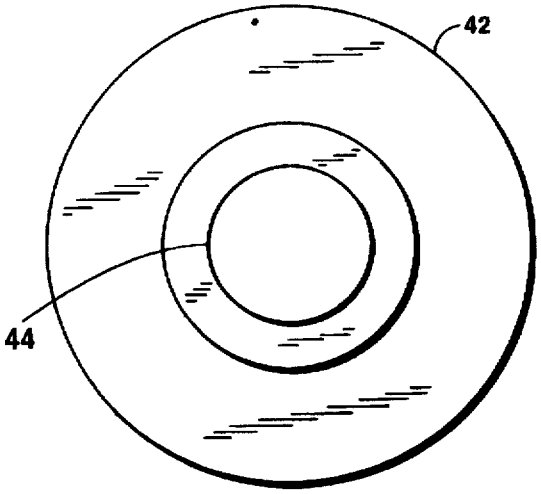
FIG. 6 is a bottom view of the second embodiment skimmer seal.

Referring now to FIG. 4, another embodiment of the invention of a seal 30 is shown having a resilient body 32 forming the outside of the invention, and it is substantially closed and formed of resilient resin material. An upper portion 33 of the body 12 has generally a cylindrical shape and a plurality of vertically stacked sections 34 having alternating concave 36 and convex 38 edges forming a side wall. A lower portion 42 of the body 32 comprises a conical shape with a cylindrical projection 44 extending from the bottom of the truncated lower portion 42, the cylindrical projection 44 extending downward from the conical portion 42 and has external threads 46 for threading into an adapter as described hereinbefore or into a water intake line connected to pool filtration equipment. The top of the body 32 comprises a self-sealing air valve 46 which is positioned in the center of pie-shaped projections 48 that extend upward to permit a finger grip. FIG. 5 is a plan view of the seal 30 showing the air valve 46 in the center of the pie-shaped projection 48. A hollow inner cylindrical shaft 40 extends from the top to bottom of the body 32. The wall of the inner shaft 40 is made from strong plastic material to prevent expansion and contraction. FIG. 6 shows a bottom view of the cylindrical projection 44 showing the circular opening for air flow to the water line.

Figure 7:
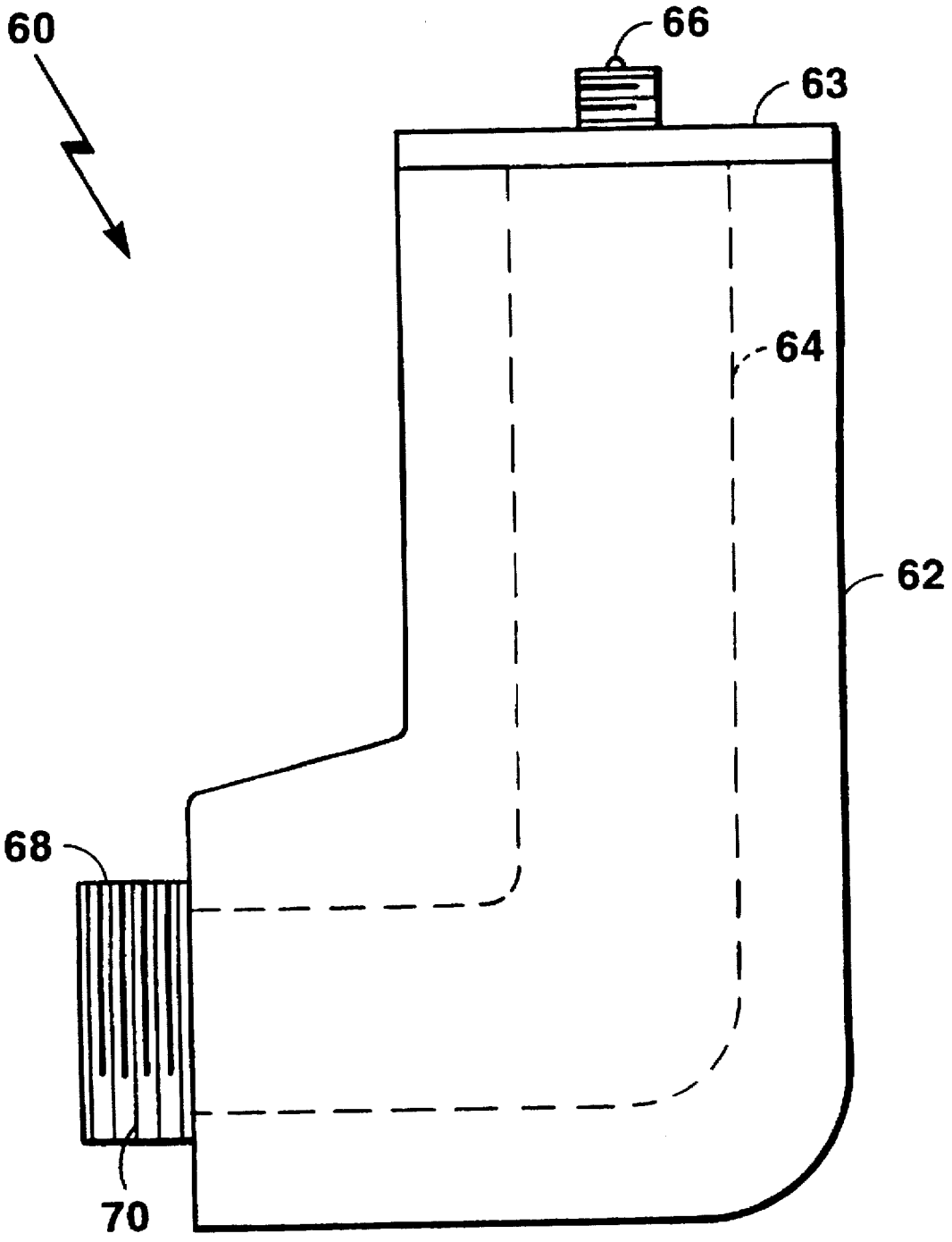
FIG. 7 is a side elevational view of a third embodiment of a pool seal having a 90° elbow.

Referring now to FIG. 7, another embodiment of a seal 60 is shown comprising a body 62 having a ninety degree elbow shape for positioning in a water line of a pool requiring such a configuration. This embodiment has a hollow inner cylindrical shaft 64 with a ninety degree elbow shape in accordance with the shape of the body 62 of the seal 60. A self-sealing air valve 66 is positioned in a top portion of the seal 60 in the center of the shaft 64. A cylindrical projection 68 extends from the lower portion of the body 62 at the opening of the inner shaft 64 for providing a passage for air flow, injected at the top in the air valve 66, to a water line.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. In a swimming pool having a skimmer including a walled region and an intake water line for connection to filtration equipment, a seal for protecting said skimmer and said water line from ice damage comprising:

a hollow body having an outer wall of resilient material, said body extending from said intake water line to be compressibly disposed within said skimmer walled region upon formation of ice therearound;

a first end of said body having valve means for introducing and maintaining air under pressure to said intake water line;

said first end comprises means extending upward for providing a grip to screw said seal into said intake water line with said valve means positioned in the center of said grip providing means;

a second end of said body having a cylindrical projection, said projection having means for securing said body to said intake water line; and means within said body extending from said first end to said second end for directing said air through said body.

2. The seal as recited in claim 1 wherein said valve means comprises a self-sealing air valve.

3. The seal as recited in claim 2 wherein said self-sealing air valve seals a pocket of air in said water line to prevent water from reentering said water line from said skimmer.

4. The seal as recited in claim 1 wherein:

said body comprises an upper portion and a lower portion;

said upper portion comprises a plurality of vertically stacked cylindrical sections having alternating concave and convex shaped edge surfaces extending to said first end; and said lower portion comprises a truncated conical shape contiguous to said first portion and extending to said second end.

5. The seal as recited in claim 1 wherein said outer wall of said body comprises blow-molded plastic for allowing the seal to expand and contract as ice accumulates in said skimmer.

6. The seal as recited in claim 1 wherein said second end of said body securing means comprises screw threads.

7. In a swimming pool having a skimmer including a walled region and an intake water line for connection to filtration equipment, a seal for protecting said skimmer and said water line from ice damage comprising:

a hollow body having an outer wall of resilient material, said body extending from said intake water line to be compressibly disposed within said skimmer walled regions upon formation of ice therearound;

a first end of said body having valve means for introducing and maintaining air under pressure to said intake water line;

a second end of said body having a cylindrical projection, said projection having means for securing said body to said intake water line; and means within said body extending from said first end to said second end for directing said air through said body, said air directing means including a shaft having a strong wall for preventing expansion and contraction of said shaft wall.

8. The seal as recited in claim 7 wherein said valve means comprises a self-sealing air valve.

9. The seal as recited in claim 8 wherein said self sealing air valve seals a pocket of air in said water lines to prevent water from reentering said water lines from said skimmer.

10. The seal as recited in claim 7 wherein said outer wall of said body comprises plastic for allowing the seal to expand and contract as ice accumulates in said skimmer.

11. The seal as recited in claim 7 wherein said second end of said body securing means comprises screw threads.

12. The seal as recited in claim 7 wherein:

said body comprises an upper portion and a lower portion, said upper portion comprises a plurality of vertically stacked cylindrical sections having alternating concave and convex shaped edge surfaces extending to said first end; and said lower portion comprises a truncated conical shape contiguous to said first portion and extending to said second end.

13. The seal as recited in claim 7 wherein said first end comprises means extending upward for providing a grip to screw said seal into said intake water line with said valve means positioned in the center of said grip providing means.

14. The seal as recited in claim 7 wherein: said body comprises a first portion and a second portion, said first portion of said body extending in a first direction and said second portion extending in a second direction approximately ninety degrees relative to said first direction of said first portion.

* * * * *